US005522377A

United States Patent [19]

Fritz

[11] Patent Number: 5,522,377

[45] Date of Patent: Jun. 4, 1996

[54] ADJUSTABLE EXHAUST HOOD

[75] Inventor: Frederick F. Fritz, Stanwood, Mich.

[73] Assignee: Randell Manufacturing, Inc., Weidman, Mich.

[21] Appl. No.: 241,727

[22] Filed: May 12, 1994

[51] Int. Cl.[6] ..... F24C 15/20

[52] U.S. Cl. ..... 126/299 R; 126/299 D; 55/DIG. 36

[58] Field of Search ..... 126/299 R, 299 D, 126/299 E, 300–303, 285 A, 307 R, 312; 454/61, 62, 67; 55/418, DIG. 36

[56] References Cited

U.S. PATENT DOCUMENTS

| | | | |
|---|---|---|---|
| 1,916,907 | 7/1933 | Sargent | 55/418 |
| 2,862,437 | 12/1958 | Smith et al. | 126/299 D |
| 3,194,146 | 7/1965 | Jenson . | |
| 3,910,782 | 10/1975 | Struble et al. . | |
| 4,029,002 | 6/1977 | Vandas . | |
| 4,109,641 | 8/1978 | Hunzicker . | |
| 4,117,833 | 10/1978 | Mueller . | |
| 4,281,635 | 8/1981 | Gaylord . | |
| 4,811,724 | 3/1989 | Aalto et al. | 126/299 D |

FOREIGN PATENT DOCUMENTS

| | | | |
|---|---|---|---|
| 442410 | 11/1923 | Germany | 55/418 |
| 1547657 | 6/1979 | United Kingdom | 126/299 D |

*Primary Examiner*—James C. Yeung
*Attorney, Agent, or Firm*—Varnum, Riddering, Schmidt & Howlett

[57] ABSTRACT

An exhaust hood is disclosed which comprises an open underside and a grease filter defining an exhaust plenum between the hood and the grease filter and a flow path through the grease filter. A shutter-like panel is slidable into the flow path adjacent to the grease filter for blocking a portion of the flow path to adjust a volume of air flowing through the exhaust hood. Multiple side-by-side panels may be provided and each panel preferably tapers in height across its width.

17 Claims, 3 Drawing Sheets

ADJUSTABLE EXHAUST HOOD

BACKGROUND OF THE INVENTION

1. Field of the Invention

This invention relates to an exhaust hood for removing air laden with grease, smoke or other contaminants from a working environment, and more specifically to such an exhaust hood provided with a mechanism for adjusting the volume of air passing through the hood.

2. Description of Related Art

Exhaust hoods are used in a variety of environments such as kitchens, laboratories and factories for exhausting heated or contaminated air from a working environment. In a restaurant kitchen, for example, there are usually a number of cooking units aligned in a row. Some of these units, broilers and fryers for example, may produce considerable quantities of smoke, fumes, grease particles and moisture, while other units such as ranges and griddles may generate such pollutants in considerably smaller amounts. Kitchen exhaust ventilators have traditionally been designed with enough airflow capacity to remove pollutants from broilers, fryers and other more active pollution-generating cooking units. This results in excessive ventilation for those cooking units which generate less pollution, such as the ranges and griddles.

A typical exhaust hood comprises a housing in the form of a box-like structure with an intake comprising an open underside, and an exhaust duct leading outwardly from its upper side. Air from the kitchen environment passes into the housing through a series of grease filters, and into an exhaust plenum above the grease filters. From the exhaust plenum, it is drawn out of the hood through the exhaust duct. In a kitchen the hoods are typically horizontally elongated to accommodate a row of cooking units.

An elongated hood may give rise to uneven distribution of air across the width of the hood. The portion of the hood directly beneath the exhaust duct tends to remove air at the greatest volume-rate, while portions of the hood displaced from the exhaust duct tend to exhaust air at lower volume-rates. A common solution to this problem is to situate the most active of the pollution-generating cooking units directly beneath the exhaust duct and to place the least active pollution-generating units furthest from the exhaust duct. However, such an arrangement may not promote optimal efficiency of the cooks working at the equipment, and many chefs prefer to experiment with different equipment locations to achieve maximum efficiency within the kitchen.

To improve the flow distribution across a given exhaust hood, prior designs have incorporated a flow restriction strategically located in the path of the exhaust air to provide a desired flow distribution. For example, U.S. Pat. No. 4,281,635, issued Aug. 4, 1981 to E. C. Gaylord, discloses a kitchen ventilator or exhaust hood mounted over an arrangement of kitchen equipment which includes a broiler, a fryer, a range and a griddle. Air and grease pass from the equipment through an inlet opening and take a circuitous path through a series of opposing horizontal baffles to extract grease and other contaminants. A damper baffle mounted on a horizontal pivot at the inlet opening is pivotable toward and away from the lowest baffle to vary the width of a gap between the damper and the baffle, whereby to vary the volume of air flowing past the damper. To accommodate the varying exhaust requirements of different pieces of kitchen equipment, additional baffling is provided to reduce the rate of air flow into portions of the ventilator positioned above the range and griddle units. The additional baffling comprises choke plates attached to the hood in strategic locations and extending into the path of the exhaust air passing through the grease baffles. Several of the choke plates are bolted in place and others are spot-welded in place. To rearrange equipment beneath the exhaust hood, the choke plates must be removed and repositioned. To remove those choke plates which are spot-welded, the welds must be burned off.

SUMMARY OF THE INVENTION

The exhaust hood of the present invention provides a simpler and more effective solution to the problem of providing air distribution across the exhaust hood which accommodates the requirements of various arrangements of equipment beneath the hood.

More particularly, the invention provides an exhaust hood in which a housing and a grease filter cooperate to define an exhaust plenum and a flow path through the grease filter, and in which the improvement comprises a shutter panel slidable into the flow path adjacent to the grease filter to block a portion of the flow path and thereby adjust the volume of air flowing through the exhaust hood.

The height of the shutter panel varies between its ends, whereby the amount of flow restriction effected by the panel varies correspondingly between the ends. In a preferred embodiment the upper and lower edges of the panel converge so that the height of the panel tapers uniformly from one end to the other. Also in the preferred embodiment the panel is reversibly mounted within the housing.

The invention also provides a method of adjusting air flow in an exhaust hood having an open underside, a grease filter and means defining a flow path extending from the open underside through the grease filter, the method comprising the steps of mounting a panel adjacent to the grease filter for slidable movement across a face of the grease filter, and reducing the air flow through the exhaust hood by sliding at least a portion of the panel into the flow path to restrict a portion of the flow. The latter step may be performed by varying the shape of the portion of the panel within the flow path to vary the volume of air flow across the width of the flow path.

Other features and advantages of the invention will be apparent from the ensuing description in conjunction with the accompanying drawings.

DESCRIPTION

Figure 1:
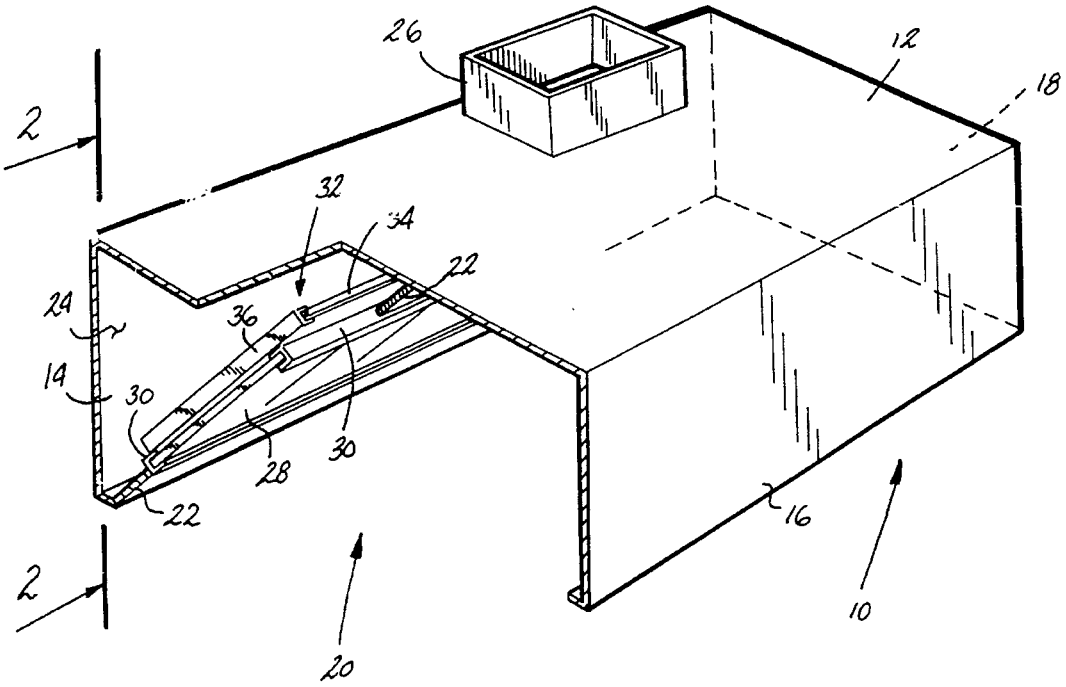
FIG. 1 is a partial sectional perspective view of an exhaust hood according to the invention.

Referring now to the drawings and to FIG. 1 in particular, an exhaust hood 10 is shown which includes a housing comprising upper rear front and side panels 12, 14, 16 and 18 forming a generally rectangular box-like structure having an open underside 20. A dividing wall 22 slopes from a rear portion of the underside 20 upwardly and forwardly towards the top panel 12 to define an exhaust plenum 24 within the exhaust hood 10 above the dividing wall 22. An exhaust duct 26 extends upwardly and outwardly from the exhaust plenum 24 through the top panel 12. Suction applied to the exhaust duct 26, as by an exhaust fan (not shown), draws air from the exhaust plenum 24 out of the exhaust hood 10 through the exhaust duct 26.

A portion of the dividing wall 22 comprises a grease filter 28 of a type ordinarily used in the art. Typically, an exhaust hood such as the hood 10 will have several grease filters 28 arranged in side-by-side arrangement to span the full width of the exhaust hood. The grease filters 28 are mounted in upper and lower U-shaped horizontally disposed channels 30 in the ordinary fashion.

Figure 2:
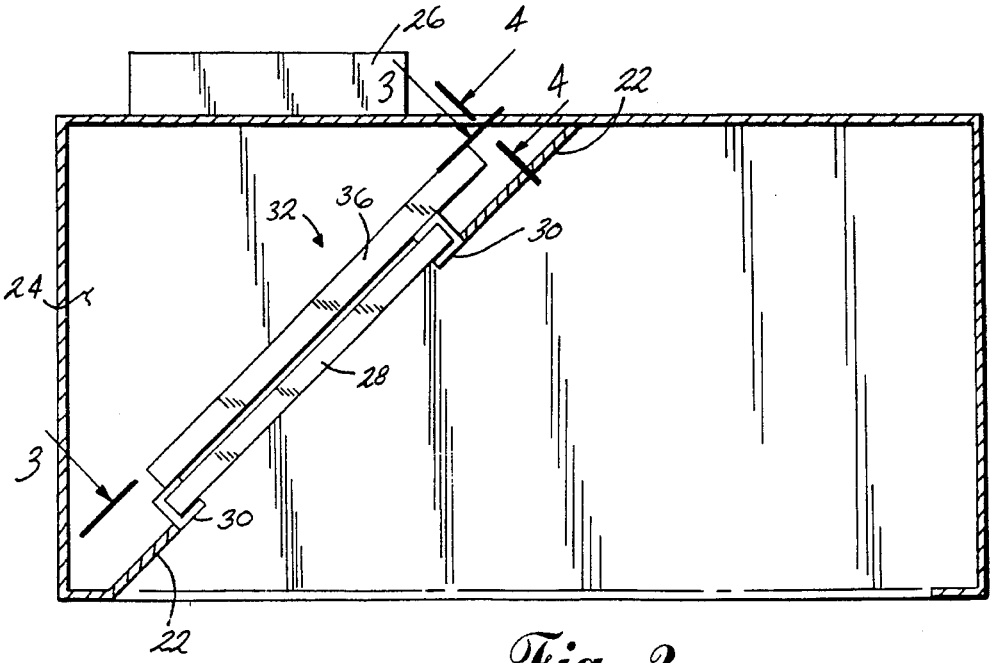
FIG. 2 is a side elevational view in cross-section of the exhaust hood of FIG. 1 taken along line 2—2 of FIG. 1.

Turning to FIG. 2, the grease filters 28 thus slope upwardly and forwardly at an approximately 45° angle. A flow adjusting mechanism 32 is disposed immediately behind the grease filters 28. The flow adjusting mechanism 32 comprises one or more shutter-like panels 34 slidably mounted behind and parallel to the grease filters 28. Preferably, a pair of elongated U-shaped channels 36 are provided for slidably receiving the panel 34. The panel 34 slides within the channels 36 parallel to the grease filters 28 to selectively cover and uncover portions of the grease filters 28 and thereby adjust the quantity of air flowing through the hood. Preferably, the components of the flow adjusting mechanism 32 are formed of stainless steel or aluminized steel.

Figure 3:
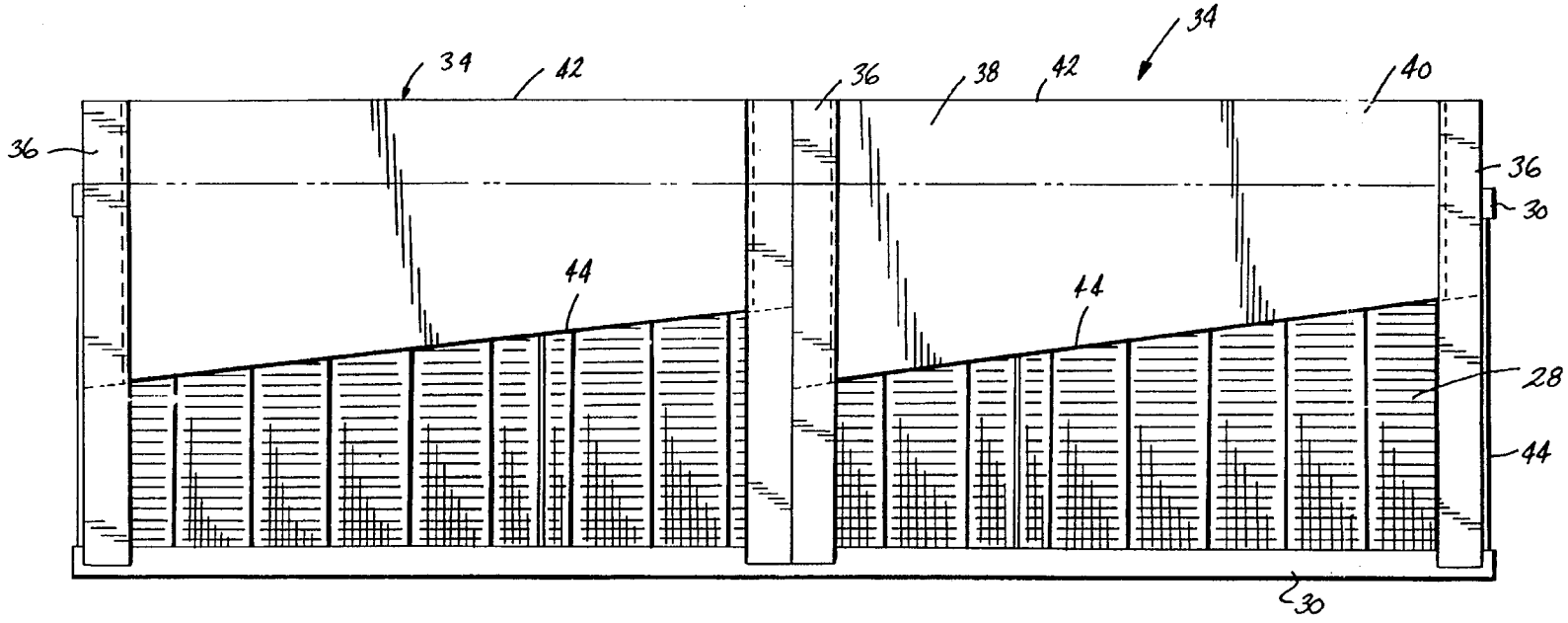
FIG. 3 is a sectional view of the hood of FIG. 1 taken along line 3—3 of FIG. 2 and illustrating grease baffles and an adjustable flow restriction panel according to the invention.

Turning to FIG. 3, it can be seen that the panel has the shape of an elongated, truncated right triangle providing a first end 38 (corresponding to the base of the triangle) and a second end 40 (corresponding to a truncated edge of the triangle). An upper edge of the panel 42 is essentially horizontal, while a lower edge 44 slopes slightly upwardly toward the panel second end 40. Preferably, the height of the panel 34 (distance between the upper and lower edges 42 and 44) at the first end 38 will be approximately twice the height at the second end 40. Thus, the panel first end 38 blocks a larger portion of the grease filters 28 than the panel second end 40 and provides for a correspondingly larger volume of air passing through the grease filter 28 adjacent to the panel second end 40.

Figure 4:
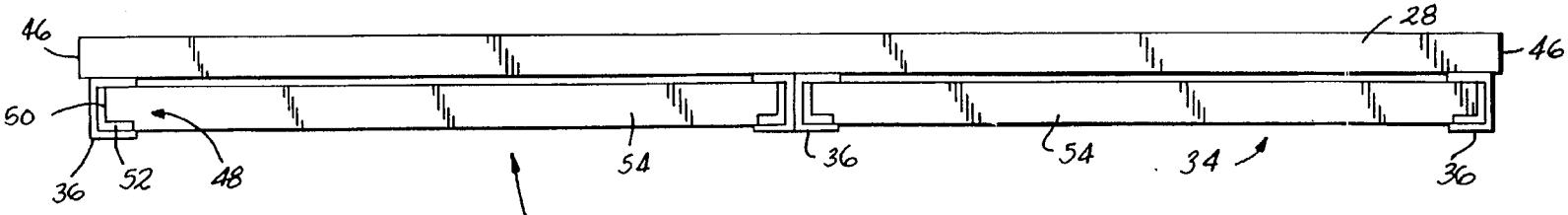
FIG. 4 is a sectional view of a portion of the hood of FIG. 1 taken along line 4—4 of FIG. 2 and illustrating a mounting arrangement for the adjustable flow restriction panel of FIG. 3.
Figure 5:
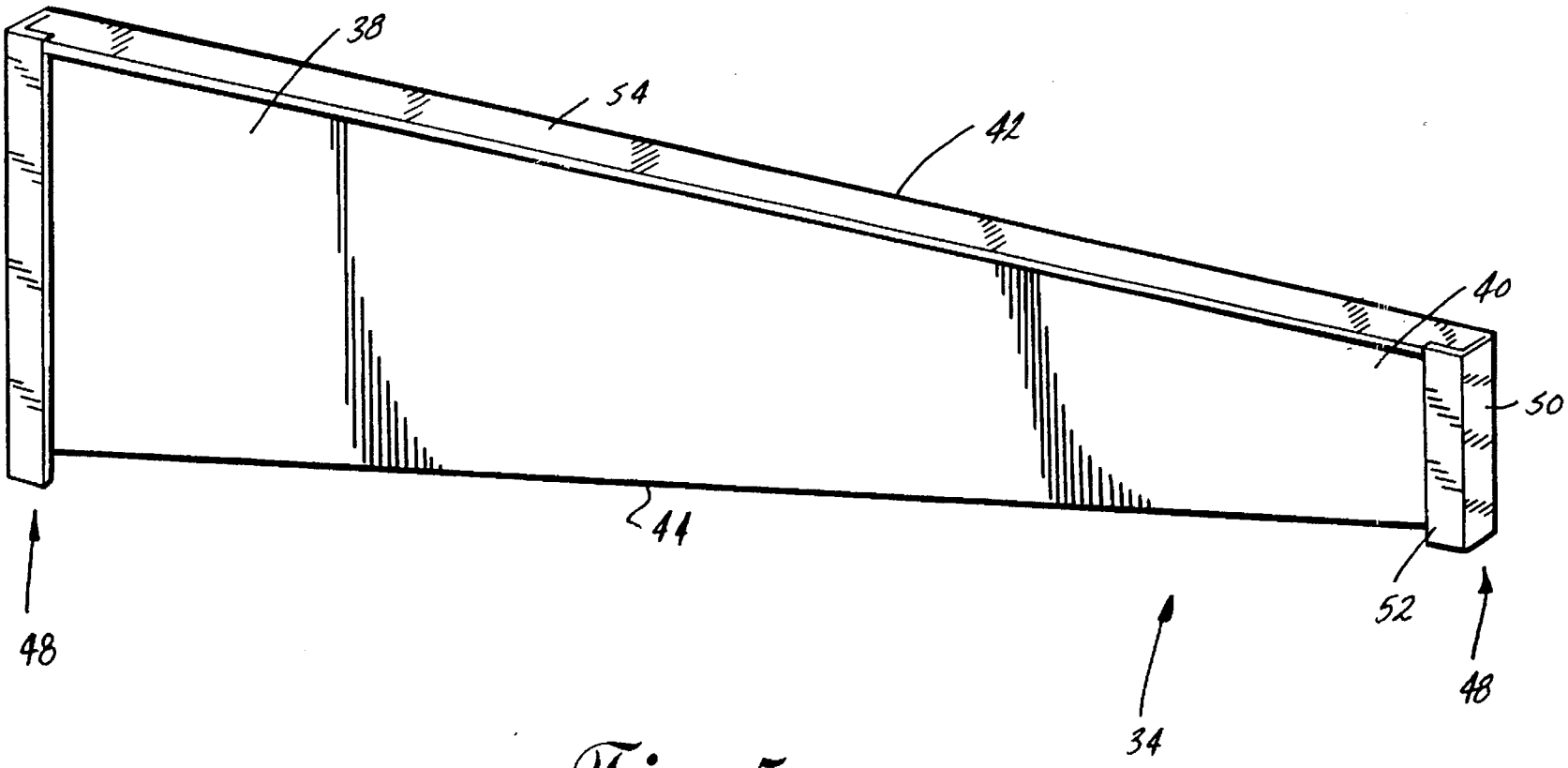
FIG. 5 is a perspective view of the adjustable flow restriction panel of FIG. 3.

Turning to FIG. 4, it can be seen that the U-shaped channels 36 are oriented along lateral edges 46 of the grease filters 28 with the open edges of the channels 36 facing each other. U-shaped return flanges 48 are provided at the first and second ends 38 and 40 of the panel 34. Each flange 48 comprises a lip 50 extending normal to the panel 34 and a second lip 52 extending from the first lip parallel to the panel 34. (See also FIG. 5). The flanges 48 are designed to slide freely within the channels 36. Some form of locking mechanism, such as a lock nut or pin (not shown), is preferably provided for holding the panel 34 at a desired location within the channels 36.

In the orientation shown in FIG. 4, the panel 34 nearly abuts the grease filters 28, whereby air cannot flow through the grease filters 28 adjacent to the panel 34 and then travel parallel to the panel 34 and out through the exhaust duct 26. However, if the panel 34 is reversed within the channels 36, the panel 34 will be spaced apart slightly from the grease filter 28. With the panel 34 in this orientation and to prevent air from flowing through the grease filter 28 adjacent to the panel 34 and travelling parallel to the panel 34 to escape into the plenum 24 and out through the exhaust 26, a lip 54 is provided at the upper edge 42 of the panel 34. If desired, an additional lip (not shown) may be provided at the panel lower edge 44.

In a typical kitchen installation, the kitchen equipment will be oriented underneath the exhaust hood 10. After the kitchen equipment has been placed into a desired arrangement, the flow adjusting mechanism 32 is adjusted to provide appropriate exhaust quantities across the width of the exhaust hood 10. For instance, the panel 34 will be inserted into the channel 36 with its narrower second end 40 positioned above the more active producers of smoke, fumes and grease such as the broilers and fryers. Then, the panel 34 will be moved within the channels to a desired location to produce an appropriate total volume of exhaust flow through the hood 10. Thus, the flow control mechanism 32 provides not only control over the gross volume of air exhausted through the exhaust hood 10 but also the lateral distribution of the exhaust air across the width of the exhaust hood 10.

If an even distribution of air is desired across the exhaust hood 10, the exhaust duct 26 can be located adjacent to one side 18 of the exhaust hood 10 and the wider first end 38 of the panel 34 can be located at that same side. Thus, more flow restriction will be placed in front of the grease filters 28 adjacent to the exhaust duct 26 and less flow restriction placed in front of the grease filters 28 away from the exhaust duct 26 to provide an even distribution of air exhausted through the grease filters laterally across the width of the exhaust hood 10.

As shown in FIG. 3, multiple panels 34 are preferably provided in side-by-side orientation for increased flexibility in adjusting the air distribution within the exhaust hood 10. Various orientations of side-by-side panels can be provided. For instance, two panels 34 can be provided with their wide first ends 38 located in a central section of the hood 10 and their narrower second ends 40 located adjacent to the sides of the hoods 18. In this orientation, with an exhaust duct 26 located in the center of the hood 10, an even distribution of air can be provided as the greater suction effect in the center of the hood due to the location of the exhaust duct would be negated by the greater blockage of the grease filters 28 in the center of the hood. Each panel 34 could be independently adjusted. Also, multiple panels can be provided, one behind the other.

By varying the angle of the lower edge 44 relative to the upper edge 42, a greater degree of flow restriction is provided on one side of the hood versus the other. Also, other shapes may be provided for the panel 34. For instance, the lower edge 44 can be made parallel the upper edge 42 with one of the upper or lower edges 42 or 44 provided with a discontinuity to vary the height (distance between the upper and lower edges 42 and 44) of the panel 34 from one end 38 to the other 40. When employed in a kitchen, the exhaust hood 10 could be provided with separate panels 34 in side-by-side relation corresponding to each piece of kitchen equipment located beneath the exhaust hood 10. However, for most applications, an arrangement having one or two panels 34 shaped as illustrated in FIG. 3 provides ample adjustability of flow distribution across the exhaust hood 10 with a simple and uncomplicated structure.

While the invention has been particularly described in connection with certain specific embodiments thereof, it is to be understood that this is by way of illustration and not of limitation, and the scope of the appended claims should be construed as broadly as the prior art will permit.

What is claimed is:

1. In an exhaust hood comprising a housing having an open underside, a grease filter defining a first plane, and an air adjusting mechanism, the housing and the grease filter cooperating to define an exhaust plenum therebetween and a flow path through the grease filter, the improvement wherein the air adjusting mechanism comprises:

a shutter panel mounted adjacent to the grease filter in a second plane parallel to the first plane, and slidable into the flow path therethrough, the shutter panel having a cross-sectional area in the flow path always less than the cross-sectional area of the flow path wherein the flow path cannot be completely blocked by the shutter panel, and further having a first end and a second end with the height thereof varying from the first end to the second end, whereby to adjust the distribution of air flowing across the open underside of the exhaust hood without decreasing the volume of air flowing through the exhaust hood.

2. An exhaust hood according to claim 1, including a pair of opposed channel members mounted in the second plane, the shutter panel having a first end and a second end opposite from the first end, each of the ends having a flange slidably received within a respective one of the channel members.

3. An exhaust hood according to claim 2, wherein the flanges are similarly shaped, whereby either of the flanges is receivable within each of the channels and the shutter panel is thereby reversible.

4. An exhaust hood according to claim 1, wherein the second plane is disposed above the first plane.

5. An exhaust hood according to claim 1, wherein the shutter panel has an upper edge and a lower edge opposite the upper edge, the edges extending between the ends of the panel means and converging.

6. An exhaust hood according to claim 1, wherein the height of the shutter panel tapers uniformly from the first end to the second end.

7. An exhaust hood according to claim 1, wherein the height of the shutter panel at the first end is approximately twice the height at the second end.

8. An exhaust hood according to claim 1, including a pair of opposed channel members mounted in the second plane, each of the ends of the shutter panel having a flange slidably received within a respective one of the channel members.

9. An exhaust hood according to claim 8, wherein the flanges are similarly shaped, whereby either of the flanges is receivable within each of the channels and the shutter panel is thereby reversible.

10. An exhaust hood according to claim 1, including a second shutter panel mounted adjacent to the grease filter for sliding movement in the second plane into the flow path, the second shutter panel being disposed horizontally adjacent to said one shutter panel.

11. An exhaust hood according to claim 10, wherein the configuration of the second shutter panel is substantially similar to that of said one shutter panel.

12. An exhaust hood comprising:

a housing having an open underside, a grease filter, the housing and the grease filter cooperating to define an exhaust plenum therebetween and a flow path through the grease filter from the open underside to the plenum, a mounting fixture near the grease filter, and at least two shutter panels disposed within the mounting fixture, each panel being independently slidable into the flow path, the mounting fixture and shutter panels presenting a face across the flow path, whereby to adjust the distribution of air flowing through the exhaust hood over the face.

13. An exhaust hood according to claim 12, wherein each shutter panel is planar.

14. An exhaust hood according to claim 13, wherein the height of each shutter panel varies across its width.

15. An exhaust hood according to claim 14, wherein at least one panel is reversibly mounted within the housing.

16. A method of adjusting air flow through an exhaust hood having an open underside, a grease filter and means defining a flow path extending from the open underside through the grease filter, comprising the steps of:

mounting at least two panels adjacent to the grease filter for slidable movement across a face of the grease filter; and redistributing the air flow through the exhaust hood by sliding at least one panel into the flow path to restrict a portion of the flow.

17. In a kitchen exhaust hood comprising a housing having an open underside, a grease filter, and an air adjusting mechanism, the housing and the grease filter cooperating to define an exhaust plenum therebetween and a flow path through the grease filter, the improvement wherein the air adjusting mechanism comprises:

at least two shutter panels mounted adjacent to the grease filter, each panel being independently slidable into the flow path therethrough, the panels being mounted side by side, and extending from a first end of the grease filter to a second end of the grease filter opposite the first end wherein the area of the flow path is adjustable from the first end to the second end by slidable movement of at least one shutter panel.

* * * * *